US010417939B2

(12) United States Patent
Hogan

(10) Patent No.: US 10,417,939 B2
(45) Date of Patent: Sep. 17, 2019

(54) ERASABLE LOOP SCHEDULER WITH CALENDAR

(71) Applicant: Richard J. Hogan, Ixonia, WI (US)

(72) Inventor: Richard J. Hogan, Ixonia, WI (US)

( * ) Notice: Subject to any disclaimer, the term of this patent is extended or adjusted under 35 U.S.C. 154(b) by 0 days.

(21) Appl. No.: 15/595,320

(22) Filed: May 15, 2017

(65) Prior Publication Data

US 2017/0249873 A1 Aug. 31, 2017

Related U.S. Application Data

(63) Continuation of application No. 14/285,010, filed on May 22, 2014, now Pat. No. 9,653,005.

(60) Provisional application No. 61/855,799, filed on May 24, 2013.

(51) Int. Cl.

| | |
|---|---|
| ***G09D 3/00*** | (2006.01) |
| ***G09D 3/06*** | (2006.01) |
| ***B42D 5/04*** | (2006.01) |
| *G09D 3/10* | (2006.01) |

(52) U.S. Cl.

CPC ..... *G09D 3/00* (2013.01); *B42D 5/046* (2013.01); *B42D 5/047* (2013.01); *G09D 3/06* (2013.01); *B42D 5/048* (2013.01); *G09D 3/10* (2013.01)

(58) Field of Classification Search

CPC ..... G09F 3/10; B42D 5/04; B42D 5/048

See application file for complete search history.

(56) References Cited

U.S. PATENT DOCUMENTS

| | | | | | |
|---|---|---|---|---|---|
| 323,939 | A | * | 8/1885 | Kletzker | |
| 646,457 | A | * | 4/1900 | O'Marra | G09D 3/10 40/118 |
| 2,224,414 | A | * | 12/1940 | Spinner | B42D 5/041 40/119 |
| 3,432,952 | A | * | 3/1969 | Pratt | B42D 19/00 40/117 |
| 3,619,923 | A | * | 11/1971 | Bruner | A44C 5/0015 40/118 |
| 3,815,269 | A | * | 6/1974 | Roselli | G06C 3/00 235/98 R |
| 4,187,629 | A | * | 2/1980 | Yamada | G09D 3/04 40/109 |

(Continued)

FOREIGN PATENT DOCUMENTS

| | | | | |
|---|---|---|---|---|
| DE | 2707665 | A1 * | 8/1978 | B42D 5/046 |
| JP | 2012061805 | A * | 3/2012 | |

*Primary Examiner* — Cassandra Davis

(74) *Attorney, Agent, or Firm* — Boyle Fredrickson, S.C.

(57) ABSTRACT

An erasable loop scheduler for use with a calendar system is disclosed. The erasable loop scheduler may have a board and a loop system. The board has a first and second side, each having a viewing pane that displays a different portion of the loop system. The loop system includes a grid system that can be configured like a calendar. The calendar system allows recurring appointments to be recorded from a previous calendar and stored adjacent to the erasable loop scheduler. The erasable loop scheduler allows a user to write out a full month of dates and appointments on the first side of the board and another full month of dates and appointments on the second side of the board. Once a row of events has passed, the loop system can be advanced, at which point the row of past events moves to the second side of the board.

18 Claims, 9 Drawing Sheets

(56) References Cited

U.S. PATENT DOCUMENTS 5,560,127 A * 10/1996 Thomas ..... G09D 3/10
40/118
6,464,571 B1 * 10/2002 Talieh ..... B24B 21/04
451/11
6,877,262 B2 * 4/2005 Bianco ..... G09D 3/10
40/107

* cited by examiner

ERASABLE LOOP SCHEDULER WITH CALENDAR

CROSS-REFERENCE TO RELATED APPLICATION

This present application is a continuation-in-part and claims the benefit of priority of U.S. Non-provisional patent application Ser. No. 14/285,010 filed on May 22, 2014 and titled Erasable Loop Scheduler, the entire contents of which are hereby expressly incorporated by reference into this present application. This present application also claims the benefit of priority of U.S. Provisional Patent Application Ser. No. 61/855,799 filed May 24, 2013, the entire contents of which are hereby expressly incorporated by reference into the present application. U.S. Non-provisional patent application Ser. No. 14/285,010 also claimed the benefit of priority of U.S. Provisional Patent Application Ser. No. 61/855,799.

BACKGROUND OF THE INVENTION

1. Field of the Invention

The present invention relates in general to the field of calendars. More particularly, the present invention relates to an erasable loop scheduler and calendar that allows a user to continuously update the loop scheduler.

2. Discussion of the Related Art

As is known to those skilled in the art, a variety of personal calendars is available that allow a user to keep track of daily appointments. Traditional calendars have twelve sheets with each, sheet representing a single, static month of time in isolation. This can be problematic as a user must flip back and forth in order to schedule appointments for fixture months or review previous months for dates that might have been missed. Additionally, as the end of a month approaches, the user sees fewer and fewer days in advance before the sheet is flipped. As a result, appointments for future months that are located on another sheet can accidentally be forgotten until the calendar is flipped, or worse, missed altogether in the event that the sheet is not timely flipped.

Additionally, because of the cycle of a calendar year, a traditional calendar can only be used for one year so that the days of the month will accurately line up. As such, various embodiments of perpetual calendars have been produced such that a user can use the calendar for more than one year's time.

Many perpetual calendars feature a month-long grid. Some configurations allow a user to physically write the days of the week in, while others provide spaces that are mechanically moved to change the month and days. An issue with configurations featuring a month-long grid is that a user cannot easily erase portions of the grid without erasing the entire grid. For instance, after a week passes, a user would have to erase the top line of text and copy each row up one line at a time to keep a full upcoming month's appointments visible. Additionally, a user who decides to go through the tedious process of erasing and rewriting an upcoming month may later realize that they wish to review a previous week's information. This will be impossible if the schedule has been erased.

Some common perpetual calendars feature a month-long grid with apertures that display the month and the days. This means that the user does not have to write in the month and days when using the perpetual calendar. In operation, however, these types of perpetual calendars often involve complicated mechanical systems that can easily break and are difficult, if not impossible, to fix. Also, these types of calendars only display a month of time and do not allow a user to subsequently look at a past or future month.

What is needed, therefore, is a perpetual calendar that allows a user to view a full month of appointments without having to continuously rewrite portions of the schedule to keep a full month's information. Further, what is also needed is a perpetual calendar that can display more than a single month of time, for instance, a calendar that can keep a record of previous appointments or schedule additional appointments in the future. What is further needed is a perpetual calendar that can be used in conjunction with a calendar system including calendar sheets that allow a user to correlate the perpetual calendar with the months of a year.

SUMMARY AND OBJECTS OF THE INVENTION

By way of summary, the present invention is directed to an erasable loop scheduler. A primary object of the invention is to provide an apparatus that allows for continuous use of a calendar. One aspect of the apparatus is a board with at least one viewing pane. A second aspect of the apparatus is a loop system that wraps around the board such that the loop system can continually be looped around the board. A third aspect of the apparatus is a grid system in conjunction with the loop system, with at least a portion of the grid system displayed through the at least one viewing pane of the board. The apparatus includes a means for advancing the loop system.

The grid system can have a number of configurations, for instance, a calendar. Similarly, the grid system may have seven rows across by five rows high. The grid system could also be seven rows across by three rows high through ten rows high. The grid system may be printed on a flexible plastic band that can be written on with an erasable medium. A user can then write dates in the grid system to correspond with the days of a month.

The board may have a first viewing pane on a first side and a second viewing pane located on a second side opposite the first side. The first viewing pane can display a first portion of the grid system, for instance, a first month, and the second viewing pane can display a second portion of the grid system, for instance, a second month. For instance, the first viewing pane can display a current month, and the second viewing pane can display a previous month. This allows a user to review previous appointments and events. Alternatively, the first viewing pane can display a current month, and the second viewing pane can display an upcoming month. This allows the user to review two months of upcoming events.

The board may also include a plurality of mounting holes. For instance, the mounting holes may be configured such that the board can be mounted within a three-ring binder. Alternatively, the holes may be configured to allow the board to be mounted to a wall.

In accordance with another aspect of the invention, the erasable loop scheduler can also include a calendar system with an upper panel and a plurality of calendar sheets. Each of the calendar sheets may have text related to a specific month on one side of the calendar sheet and a corresponding gridded calendar on the opposite side of the calendar sheet. In this way, the calendar system can serve as a guide to a user when filling out the erasable loop scheduler.

Another object of the invention is to provide a method of using an erasable loop scheduler connected to a calendar system. First, a user will record any reoccurring appointments from a previous calendar to the calendar system. Next, the contents of the calendar system wilt be reviewed. As a result of this review, the user will then write the dates, as well as appointments corresponding to appropriate dates, on a transparent overlay that wraps around a board and covers a first side and a second side of the board. Beneath the transparent overlay is a grid system. Once the corresponding days of the month are written onto the overlay, the user writes appointments corresponding to the appropriate dates. Next, the user grasps the transparent overlay and slides it along the board once a horizontal row of dates has passed.

The method may continue as the user flips the board over. On the opposite side of the board, a second portion of the grid system is viewable that includes previously-recorded information that has been slid from the first side of the board to the second side of the board. The user can erase expired, dates and appointments when desired and write new dates and appointments on the erased portion of the grid system.

Another object of the invention is to provide an erasable loop scheduler with a board with a first viewing pane and a second viewing pane, a grid system, and a means of advancing the grid system. The grid system is on a flexible loop system that is fitted around the board. As a result, the first-viewing pane displays one side of the grid system and the second viewing pane displays a second side of the grid system. The erasable loop scheduler can be advanced such that the user may reposition the grid system to view upcoming dates in the first viewing pane, and past dates are repositioned to be viewed in the second viewing pane.

The flexible loop system may be made of a plastic material. The grid system itself may be configured like a calendar, for example, a calendar for one complete month, Ideally, the grid system will have a plurality of cells that does not contain any written material.

The erasable loop scheduler may include picture-hanging hardware such that the calendar can be hung up. Alternatively, the erasable loop scheduler may include magnets such that it can be mounted to magnetic items.

Yet another object of the invention is to provide an erasable loop scheduler as described above in combination with a separate calendar system. The separate calendar system may be physically connected to the erasable loop scheduler. The separate calendar system may include an upper panel and a plurality of calendar sheets connected to the upper panel. Each of the plurality of calendar sheets may have a front side containing text and graphics and a back side containing a gridded calendar. Additionally, the upper panel and the plurality of calendar sheets may have a plurality of holes extending therethrough. A coil may be threaded through these holes in order to secure the upper panel to the plurality of calendar sheets. Additional holes may be formed along a bottom of the upper panel and along a top of the erasable loop scheduler. Rings may be threaded through these holes to secure the upper panel to the erasable loop scheduler. Further still, a hole may be formed in the upper panel and the calendar sheets which will align with one another. These holes are configured to accept a hook, such that the calendar can be hung from a hook.

These and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with, the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
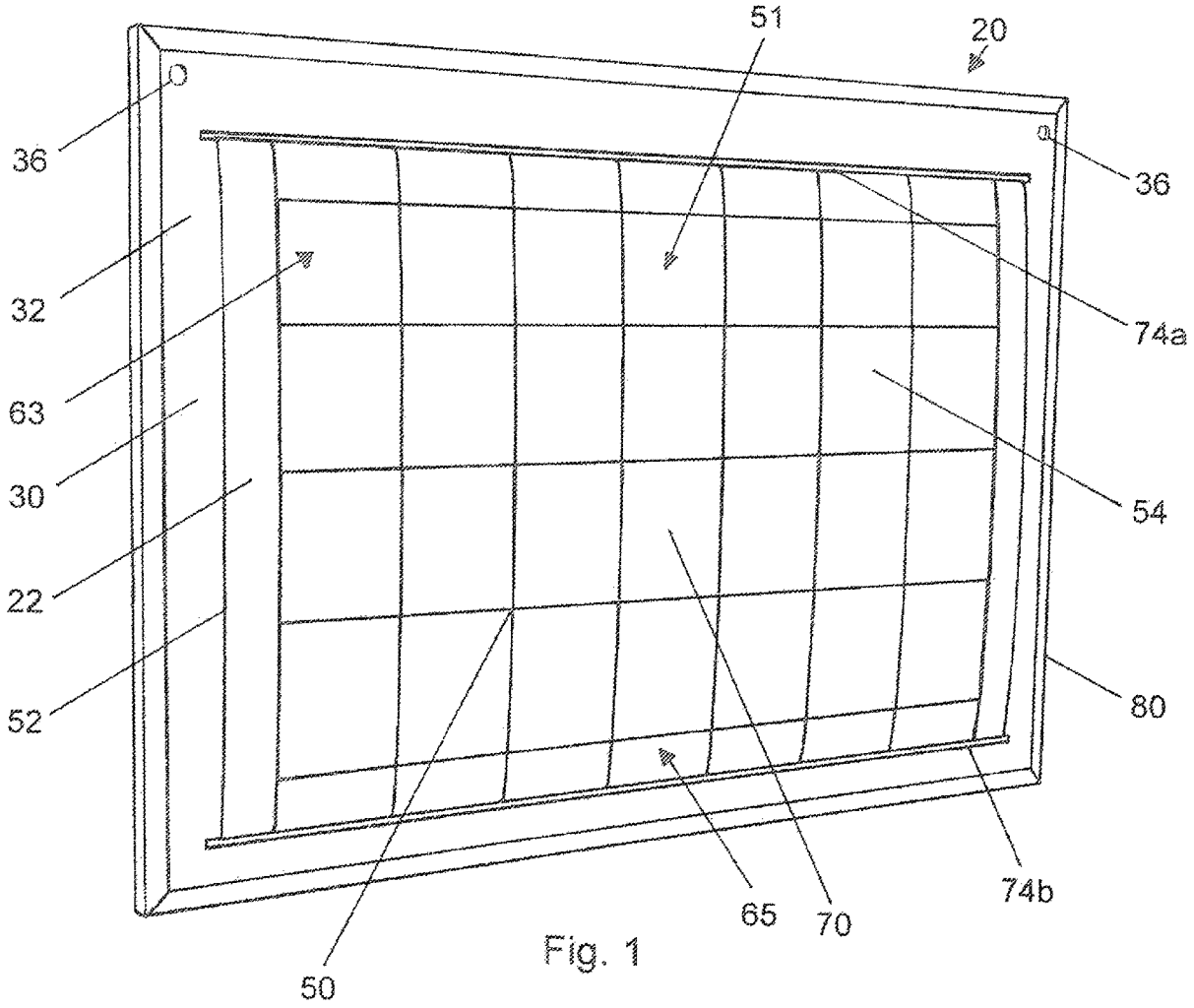
FIG. 1 illustrates a perspective view of an erasable loop scheduler of the present invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the words "connected", "attached", or terms similar thereto are often used. They are not limited to direct connection but include connection through other elements where such connection is recognized as being equivalent by those skilled in the art.

DESCRIPTION OF PREFERRED EMBODIMENTS

The present invention and the various features and advantageous details thereof are explained more fully with reference to the non-limiting embodiments described in detail in the following description.

1. System Overview

The proposed invention is an erasable loop scheduler stretched over a rigid board to create a rotating writing surface that is an improvement over existing dry/wet erasable white board calendars currently on the market. The prior art includes other perpetual calendars that use a continuous loop or belt. The prior art uses a belt with printed number and names of the months that is mechanically rotated or cycled to appear through apertures in the writing surface. The purpose of this is to save the user the task of writing and rewriting the dates and months on a dry erase calendar. The proposed invention uses the loop or belt as the writing surface without numbers or months. This means that the scheduled information is rotated and does not include any preprinted information. Additionally, the proposed invention can be much simpler in operation, as it can be operated in one embodiment with no mechanics whatsoever, but rather is rotated manually using only a user's fingers.

The erasable loop scheduler consists of a smooth-surfaced plastic loop stretched loosely over a rigid board, allowing the loop to rotate freely as the user sees fit. The rigid board can be made of cardboard, wood, plastic, metal, or any combination thereof. The board may include a frame made of any number of materials. The board may have holes, hooks, magnets, or other mounting mechanisms to hang the scheduler on a variety of surfaces according to the size and style of the erasable loop scheduler. The loop is made of an erasable, smooth-surfaced, flexible plastic or similar material. By making the surface out of a flexible loop or belt of erasable plastic, the information on the surface can be shifted so the user does not have to rewrite the information as the weeks progress. A grid system is printed on the flexible loop or belt dividing the surface into cells, with the most common configuration being that of a calendar. If used as a calendar, once the current week at the top is finished, the loop is shifted upward bringing the new week to the top and thus still have at least a month's worth of weeks still in view. This saves the user time by not having to rewrite three to four weeks of data to be able to utilize the whole calendar. This also eliminates errors that may occur in the rewriting process. The scheduler may also be mounted to the wall or other objects, such as a refrigerator. Operating the scheduler is done by pivoting the unit away from the wall on the hooks or, in the case of magnetic mounting, removing it from a steel surface, i.e., a refrigerator, and shifting the loop in the desired direction by the operator's fingers.

Another benefit is that the user has the option of retaining the old information rather than erasing it once the old information moves to the second side. As the information is rotated to the back of the calendar, the user need only flip it over and consult the past week's notations. Alternatively, the user has the option of doubling the time to schedule out. In this case, the user flips the calendar over to use the second side for a future month's scheduling. For example, the front displays the month of March and the second displays the month of April. When hinged at the top, as it would be hanging on hooks, the scheduler could be flipped such that the written information, is shown upright. When the loop is shifted to the first side, however, the information would be displayed right side up.

In accordance with another embodiment, the loop scheduler can incorporate a twelve-month calendar by attaching the calendar to the loop scheduler. A traditional wall calendar front cover is flipped up and hung on a hook. The back side of the cover is generally a picture or other kind of graphics. Below the crease is the month at hand in the traditional grid of seven days across and five to six weeks or row below. As the page is flipped to the next month, the back side of the gridded page has the graphics that become the new picture for the next month and, in turn, reveals the next gridded portion below. In short, the back, side of the gridded page for May becomes the picture for June.

However, preferably, the loop scheduler is used with a twelve-month calendar that is in a non-traditional arrangement in order for it to work properly with the loop scheduler. More specifically, the twelve-month calendar for use with the loop scheduler is arranged so that, when the picture is flipped up, the corresponding grid portion of the calendar is on the back side. Stated differently, each sheet will represent one month. The front, side of the sheet states the month along with a graphic or image, and the other side shows the grid associated with that month with the appropriate days listed. Thus, the first sheet will be for January, with the front side showing "January" as text along with graphics, and the back side showing a filled-out grid system for the month of January. The reason for this arrangement is that the grid system on the back, side is not to be displayed. Instead, it is a hidden reference calendar. The loop scheduler wall calendar appears as a traditional calendar with the graphics above and loop scheduler grid below. The hidden calendar is for recording upcoming dates such as birthdays, anniversaries, and appointments that are too far in advance for the loop scheduler to accommodate. As the year progresses, the pages of the calendar are flipped over the top crease, a wire coil, or the like revealing a new graphic for the new month. Behind these graphics is the corresponding gridded month with its recorded notable dates and appointments. So, when the loop scheduler has room for these dates, the user simply has to flip up the picture, consult the hidden calendar, and copy the information onto the loop scheduler hanging below.

In using this embodiment, the user starts by copying all important dates, i.e., birthday, anniversaries, and other recurring dates from last year's calendar onto the loop scheduler's calendar. Then, with a dry erase pen, the user first writes the date numbers in the corner of each of the loop scheduler cells. Next, the user rewrites the important dates and appointments onto the loop scheduler using the calendar as a reference. This process is repeated on the reverse side thus scheduling the next month. Because the loop scheduler uses both sides, it is capable of scheduling two months of dates. As the week ends, the user updates the loop scheduler by shifting the loop up one row of dates. The user could then consult the hidden calendar as a reminder of potential future important dates. As a result, the user can constantly see a full month's worth of days in advance. As the month ends, the loop scheduler is flipped up so that the past dates and appointments can be erased, and new dates and appointments can be written in their place. Therefore, the user can avoid end-of-the month's surprises.

2. Detailed Description of Preferred Embodiments

Figure 3:
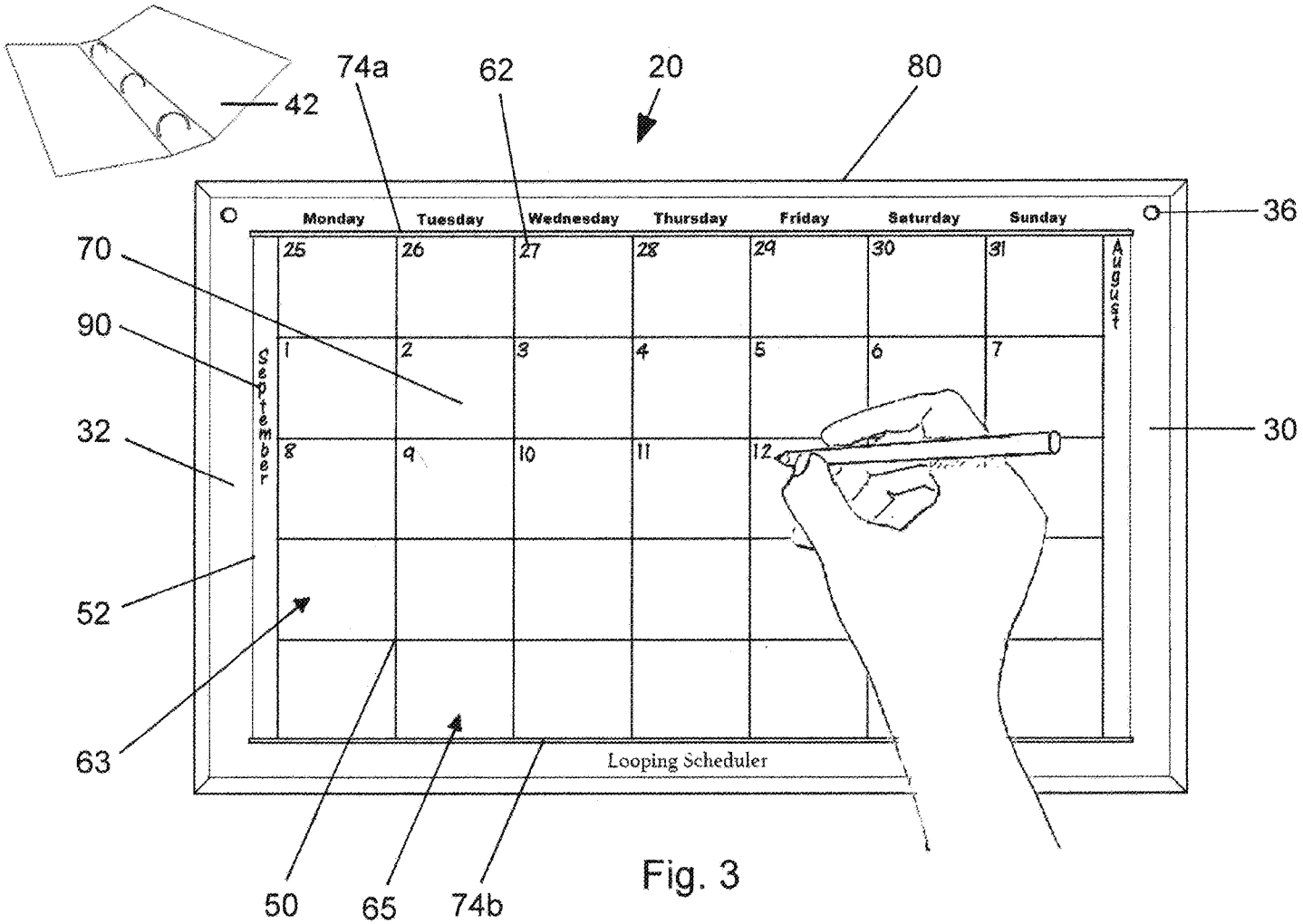
FIG. 3 illustrates a front elevation view of the erasable loop scheduler of FIG. 1 where a user is writing in dates.
Figure 6:
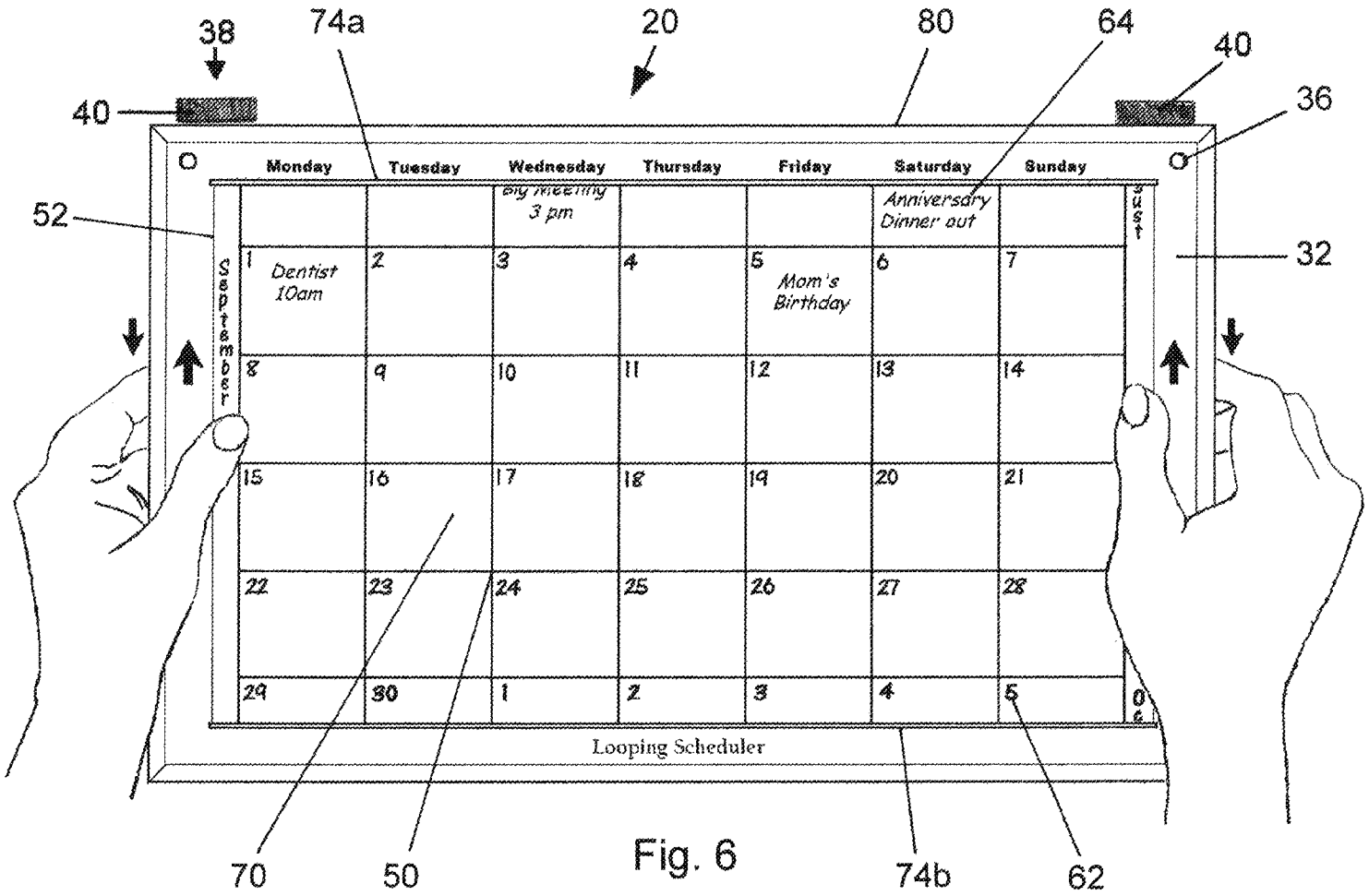
FIG. 6 illustrates a front elevation view of the erasable loop scheduler where a user slides the loop so that a new row of information is viewable on the first side.

Referring initially to FIG. 1, a perpetual calendar comprising an erasable loop scheduler 20 is provided. The erasable loop scheduler 20 has a board 30 that, is substantially flat and rigid. As such, the board 30 has a first side 32 and a second side 34, each of which can be viewed by flipping the board 30 over. The first side 32 has a viewing pane 70 through which material mounted to the board 30 can be viewed. The second side 34 may have a second viewing pane 72 that can display additional information. The erasable loop scheduler 20 can be dimensioned such that it is small and portable so that it can be easily transported. Alternatively, the erasable loop scheduler 20 may be large and configured to hang on a wall. In any configuration, the erasable loop scheduler 20 may include any number of ways to mount the board 30 to a wall or other object. For instance, the board 30 may have mounting holes 36 that allow the erasable loop scheduler 20 to be secured. In one such configuration, the mounting holes 36 may be configured to fit into a standard three-ring binder 42 as shown in FIG. 3. Alternatively, the mounting holes 36 may be used to attach the erasable loop scheduler 20 to a wall. Also, the board 30 may have a mounting system 38 such as picture-hanging hardware that allows the erasable loop scheduler 20 to be hung like a picture as can best be seen in FIG. 6. For instance, the mounting system 38 could be any combination of hooks, adhesive, or any other picture-hanging hardware as known in the art. As shown in FIG. 6, magnets 40 may also be used to attach the erasable loop scheduler 20 to other materials. The erasable loop scheduler 20 may also have an outer frame 80 connected to the board 30 for increased aesthetic appeal and overall strength to the erasable loop scheduler 20.

Figure 2:
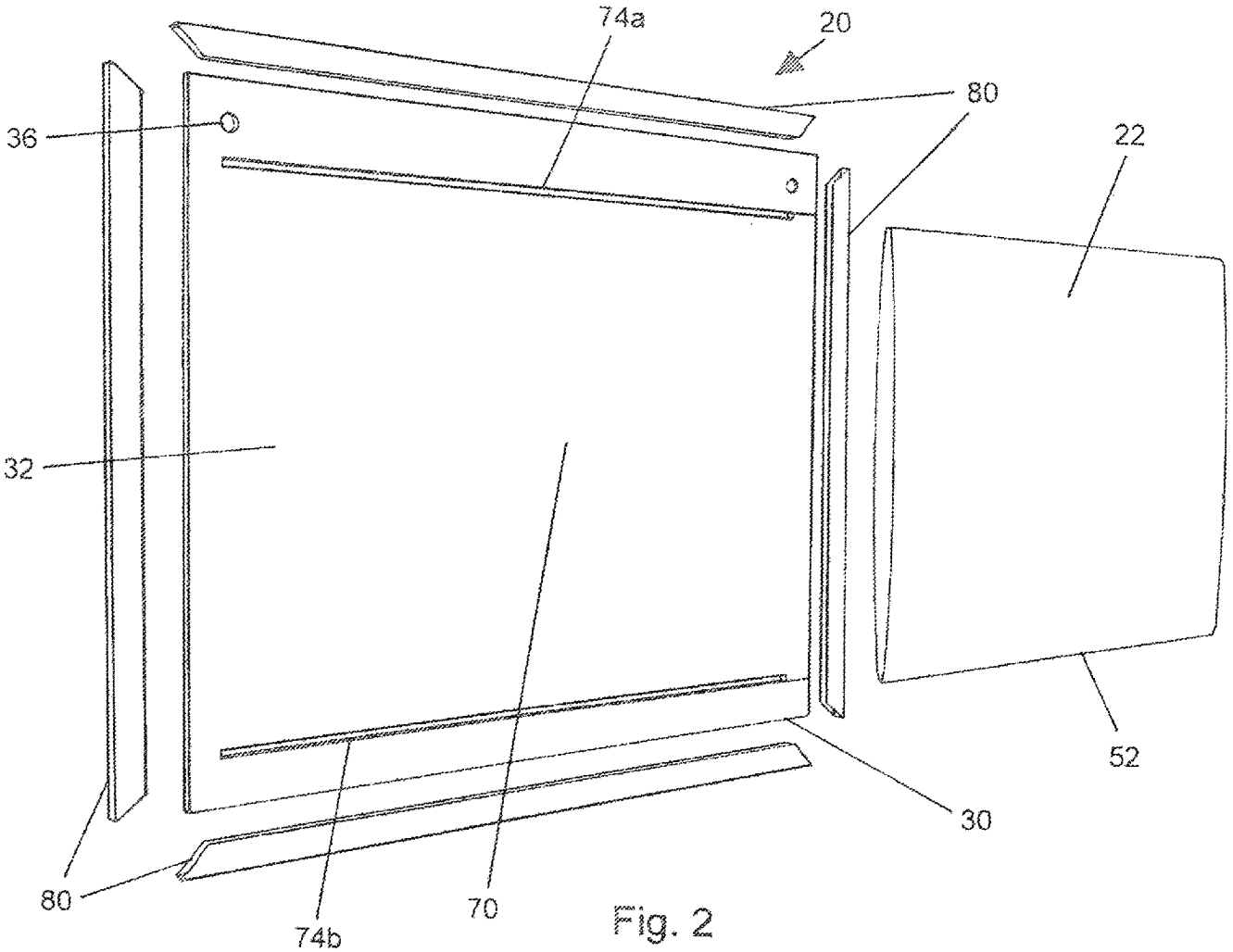
FIG. 2 illustrates an exploded view of the erasable loop scheduler of FIG. 1.

A loop system 52 wraps around the board 30 as can best be seen in FIG. 2, which shows an exploded view of the erasable loop scheduler 20. Preferably, the loop system 52 is made of a flexible material. The loop system 52 should be tight-fitting but movable around the board 30. For instance, the loop system 52 can be slid around the board 30 by a user's fingers. Alternatively, cranks, knobs, or motorized devices can be used to advance the loop system 52 about the board 30. Because the loop system 52 is continually movable about the board 30, a user can perpetually use the same loop system 52 to record information.

Still looking to FIG. 2, the loop system 52 may be a flexible plastic band which has a grid system 50 printed onto the loop system 52. Alternatively, the loop system 52 may be made of a grid system 50 printed on standard paper and then laminated or covered in a transparent overlay 22 made of flexible, plastic material. In either configuration, the outer surface of the loop system 52 may accept an erasable medium 60, for instance, ink. This allows for continued use of the same grid system 50. Preferably, the grid system 50 consists of a plurality of vertical and horizontal lines that creates a number of cells 51, similar to that of a traditional calendar. For instance, the grid system 50 could have seven vertical columns 65 to represent the seven days of the week. Additionally, the grid system 50 can have a number of horizontal rows 63, for instance, five rows 63 for one month, or ten rows 63 for two months. Other variations on the number of rows 63 could be used to allow for smaller, more portable versions of the erasable loop scheduler 20, for instance, three rows 63.

To collapse the erasable loop scheduler 20 from the exploded view, the loop system 52 can be threaded through two openings 74*a*, 74*b* that allow for easy movement of the loop system 52 about the board 30. The frame 80 is then attached to the board 30.

Figure 4:
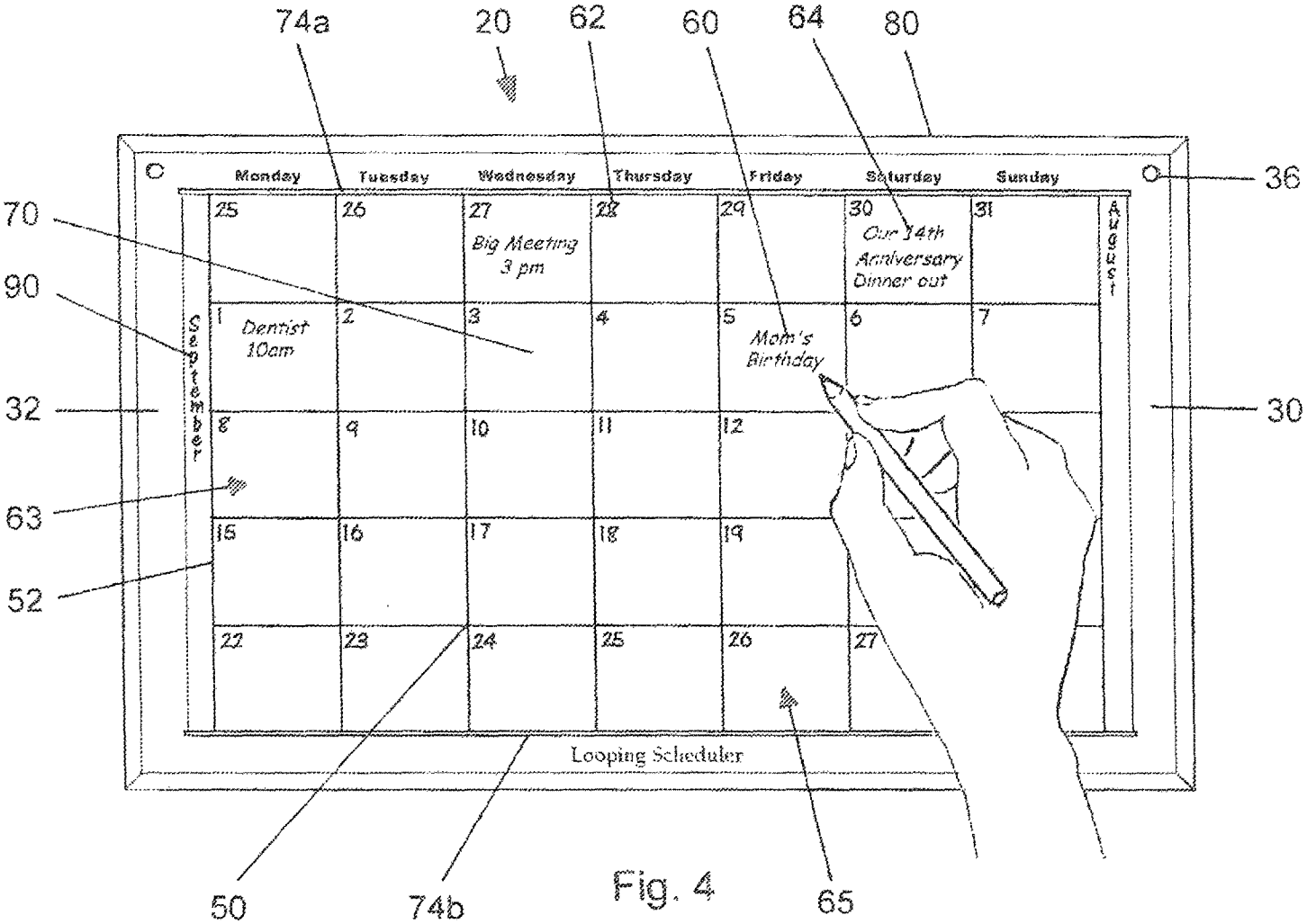
FIG. 4 illustrates a front elevation view of the erasable loop scheduler of FIG. 3 where a user is writing in appointments.

In operation, a first portion 54 of the grid system 50 of the erasable loop scheduler 20 is displayed on the first side 32 of the board 30, as can best be seen in FIG. 3. For instance, the first portion 54 of the grid system 50 may be a first month 90. As shown, the user will write dates 62 on the grid system 50. More specifically, the dates 62 should be written onto the loop system 52 on which the grid system 50 is printed. A first month 90 of dates 62 will be recorded on the grid system 50 located on the viewing pane 70 of the first side 32 of the board 30. All information written onto the grid system 50 will ideally be in an erasable medium, for instance, erasable ink. Next, a user can write corresponding appointments 64 onto the grid system 50 displayed on a viewing pane 70 of the first side 32 of the board 30, as shown in FIG. 4.

Figure 5:
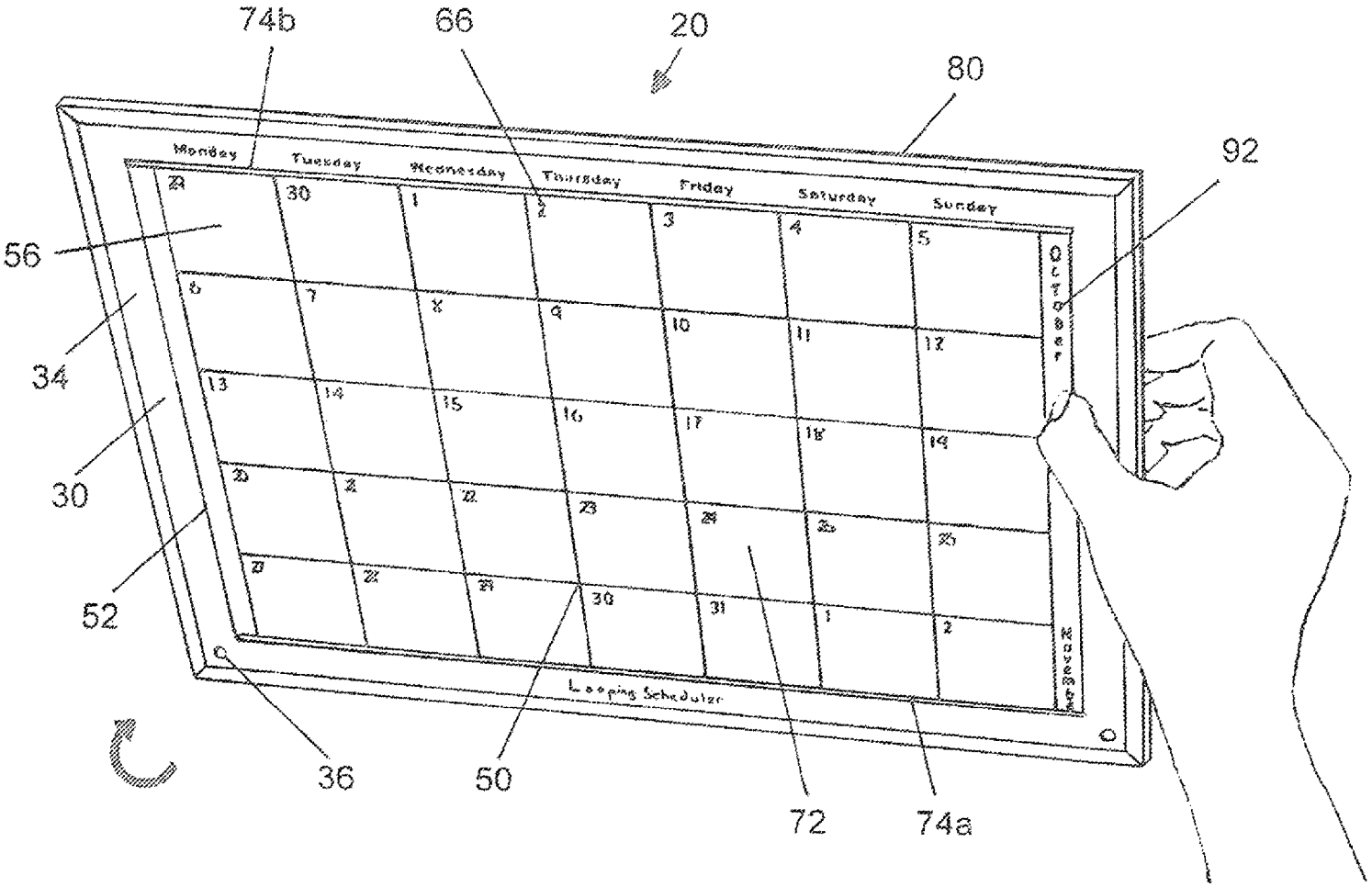
FIG. 5 illustrates a perspective view of the erasable loop scheduler when the scheduler has been flipped to a reverse side.

The board 30 can be flipped over, as best seen in FIG. 5, to display a second side 34 of the board 30 that has a second portion 56 of the grid system 50, for instance, a second month 92. This allows a user to write corresponding dates 62 and appointments 64 onto the second viewing pane 72 of the grid system 50 on the second side 34 of the board 30. The user can use the two-month display system in a number of ways. For instance, the first side 32 of the board 30 can be used to display an upcoming month, and the second side 34 of the board 30 can display a previous month. This allows a user to review previous appointments 64 and events after they have passed. Alternatively, the first side 32 of the board 30 can display an upcoming month, and the second side 34 of the board 30 can display a following month. This allows the user to review two months of upcoming events. Once a user no longer needs a row 63 of previously-recorded information 66, its contents may be erased and replaced with an upcoming week of material.

FIG. 6 illustrates one means for advancing the grid system 50 about the erasable loop scheduler. Once a row 63 of dates 62 has passed on the first side 32 of the board 30, the user may grasp the edges of the loop system 52 and slide the loop system 52 such that the row 63 of past dates 62 is moved from the first side 32 of the board 30 to the second side 34 of the board 30 through the opening 74*a*. In turn, the top row from the second side 34 of the board 30 will be moved from the second side 34 of the board 30 to the first side 32 through the opening 74*b*. The configuration of the openings 74*a*, 74*b*, in conjunction with the loop system 52, allows the loop system to continually be advanced from the first side 32 of the board 30 to the second side 34 or from the second side 34 to the first side 32. Alternative means of advancing the grid system 50 could also be employed, for instance, use of knobs, cranks, motorized devices, or other means that would be known in the art. This allows a user to always keep a full month of upcoming dates 62 available on the first side 32 of the board 30. The user can then flip the board 30 over and view the second portion 56 of the grid system 50. The user may either keep the row 63 of past dates 62 for future review, or erase the row 63 and replace it with an upcoming week of dates 62.

Figure 7:
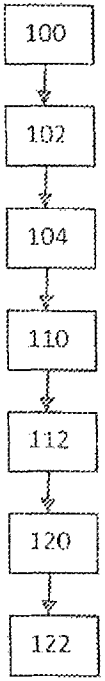
FIG. 7 illustrates a method of using the erasable loop scheduler.

Additionally, a method of using the erasable loop scheduler 20 is provided in FIG. 7. The first step is to write dates on a transparent overlay that wraps around a board that covers a first side and a second side of the board, the transparent overlay having a grid system beneath 100. Next, a user writes appointments corresponding to the appropriate dates on the transparent overlay 102. The transparent overlay can then be grasped and slid around the board when a horizontal row of dates has passed 104. In certain configurations, the board can then be flipped over 110. A second portion of the grid system can be observed which may contain previously-recorded information that has been slid from the first side of the board to the second side of the board 112. At this point, the user can keep past appointments or erase them 120. If erased, the user may then write in new dates and appointments on the erased portions of the grid system 122.

Figure 8:
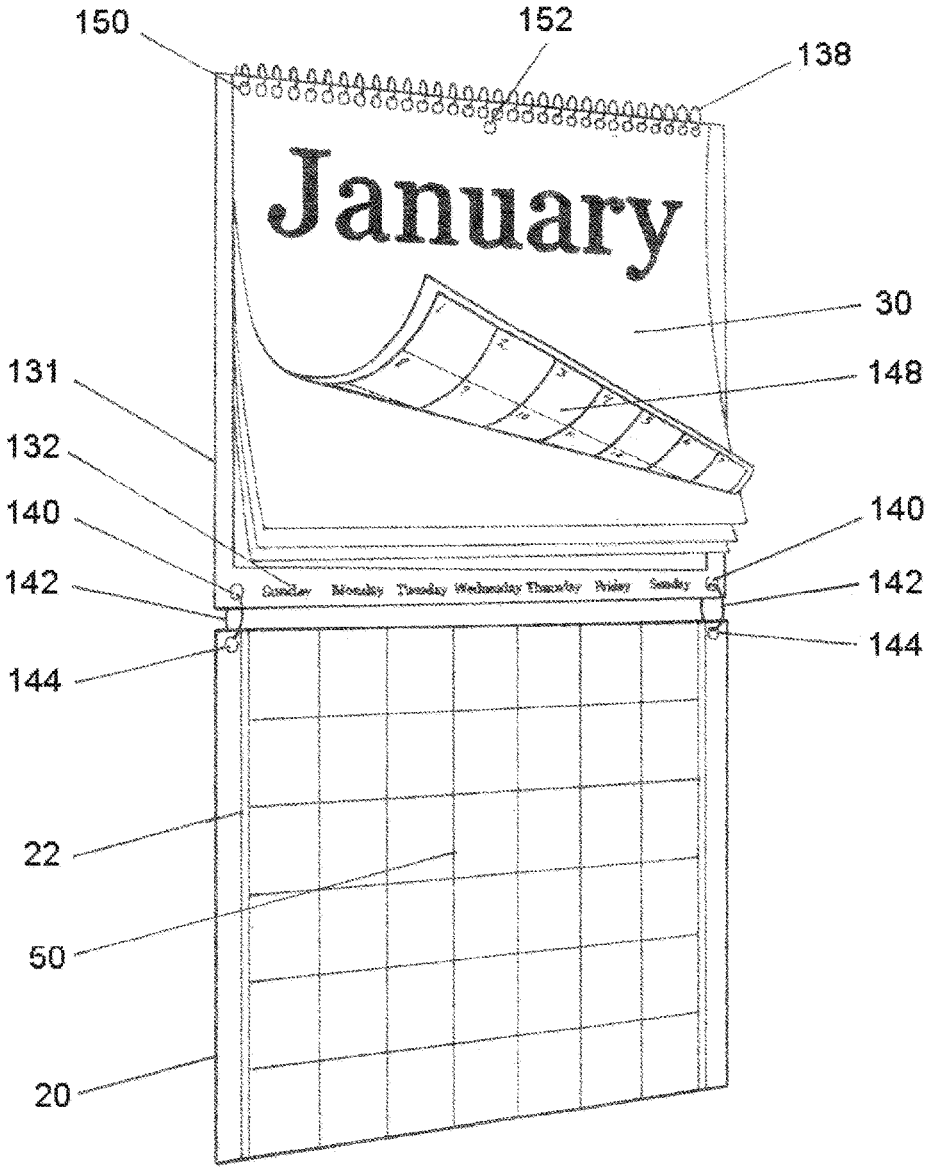
FIG. 8 illustrates a perspective view of another embodiment of an erasable loop scheduler of the present invention.
Figure 9:
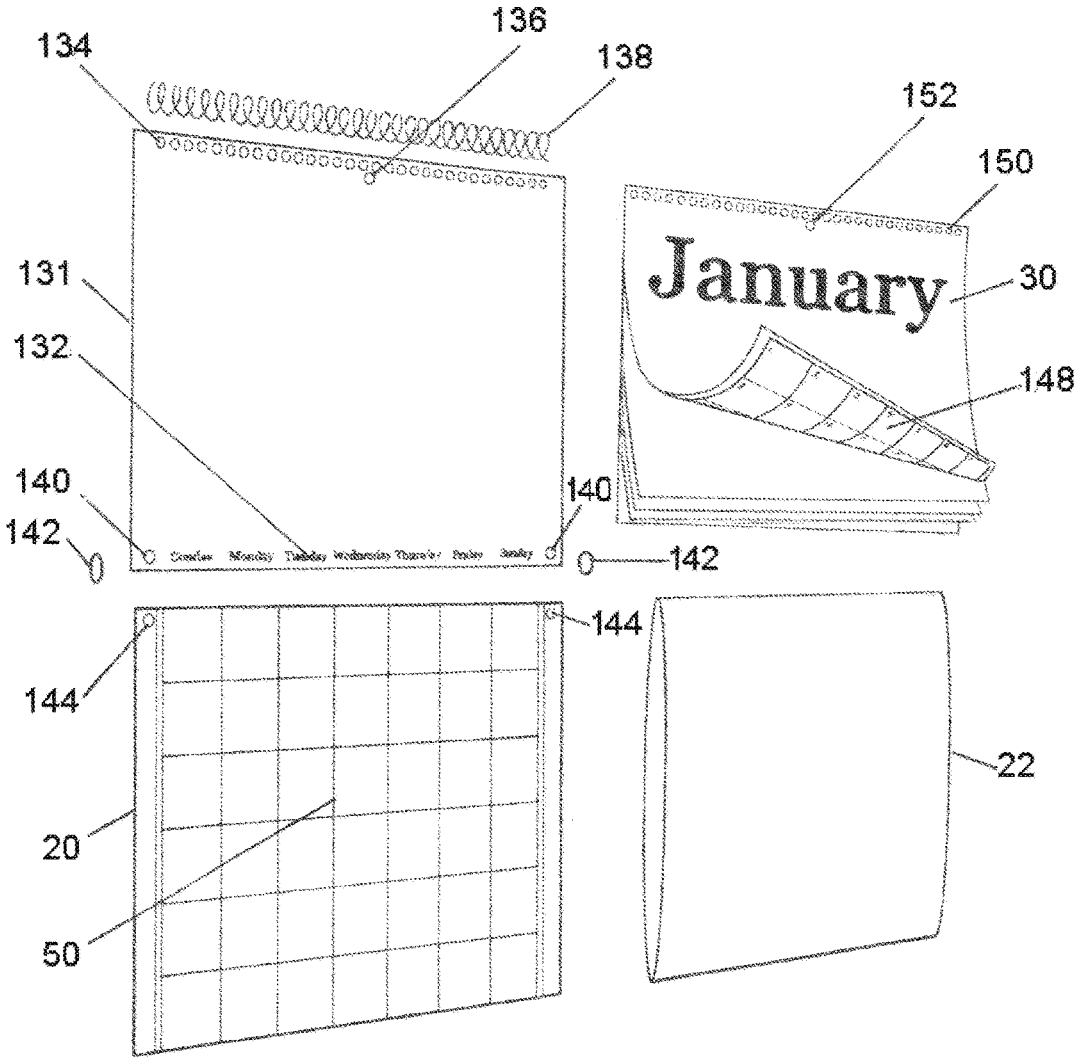
FIG. 9 illustrates an exploded view of the erasable loop scheduler of FIG. 8.

Turning now to FIGS. 8 and 9, another embodiment is shown. In this embodiment, the erasable loop scheduler 20 connects, to a separate calendar system 130. The separate calendar system 130 includes an upper panel 131 and a plurality of calendar sheets 146. The upper panel 131 can be made of cardboard or any other ridged material. Each of the calendar sheets 146 includes a gridded calendar 148 on one side and text, photographs, pictures, graphics, and the like on the other side. The front side of the calendar system 130 in the hanging position has the name of the month printed onto it and on the reverse side is the corresponding gridded calendar 148. Stated differently, the front side of the first page will have text associated with January and the reverse side has a gridded calendar 148 associated with the month of January. This is unlike traditional wall calendars where the gridded month would be on the next page. Instead, the gridded calendar 148 aligns with the month that is stated in the text on the opposite side of the sheet 146.

The upper panel 131 and calendar sheets 146 have a number of holes that line up with one another. For instance, the upper panel 131 has a top center hole 136, which corresponds to a top center hole 152 in the calendar sheets 146 for hanging the upper panel 131 and associated erasable loop scheduler 20 on a hook (not shown). Additionally, the upper panel 131 has a row of holes 134 that correspond to a row of holes 150 in the calendar sheets 146. A wire or plastic coil 138 can then be fed through these rows of holes 134, 150 to secure the upper panel 131 to the calendar sheets 146.

In both lower corners of the upper panel 131 are two additional holes 140 for attaching the calendar system 130 to holes 144 formed in the upper corners of an erasable loop scheduler 20, through which rings 142 can be threaded to allow the scheduler 20 to hang down from the calendar system 130. Additionally, the lower edge of the upper panels 131 is printed with the days of the week 132 spaced to align with the columns printed on the loop scheduler 20 hanging below. As described above, the loop scheduler 20 may be printed with a grid 50 of seven columns and six rows. The reverse side is printed exactly the same. Additionally, as described above, the scheduler 20 has a transparent overlay 22 wrapped around it that is loose enough to freely rotate around the panel 131.

In operation, the embodiment having a calendar system 130 attached to the erasable loop scheduler 20 provides several important benefits. By including the calendar system 130, the user can keep track of important dates across the term of the upcoming year. At this same time, the erasable loop scheduler 20 allows the user to continuously advance the scheduler 20 on a week-by-week basis. As a result, this embodiment provides benefits over both traditional calendars and previous loop schedulers.

Additionally, a method of using the erasable loop scheduler 20 with the calendar system 130 will be further described. First, the user starts by copying all important dates i.e. birthdays, anniversaries, and other recurring dates from last year's calendar onto the gridded calendar 148 of the calendar system 130. Then, the user writes the date numbers in the corner of each of the erasable loop schedulers 20 using the calendar system 130 as a template that lays out which days are associated with which days of the week. Next, the user rewrites the important dates and appointments from the calendar system 130 onto the erasable loop scheduler 20 using the calendar system 130 as a reference. This process is repeated on the reverse side thus scheduling the next month. Because the erasable loop scheduler 20 uses both sides, it is capable of scheduling two months of dates. As the week ends, the user updates the erasable loop scheduler 20 by shifting the loop up one row of dates. The user could then consult the calendar system 130, which is hidden when the calendar sheet 146 hangs down, as a reminder of potential future important dates. As a result, the user can constantly see a full month's worth of days in advance. As the month ends, the erasable loop scheduler 20 is flipped up so that the past dates and appointments can be erased and new dates and appointments can be written in their place.

Although the best mode contemplated by the inventor of carrying out the present invention is disclosed above, practice of the present invention is not limited thereto. It will be manifest that various additions, modifications, and rearrangements of the features of the present invention may be made without deviating from the spirit and scope of the underlying inventive concept.

For example, the grid system could be advanced any number of ways. For instance, knobs, pulleys, or other devices could be used. Similarly, although plastic is the preferred material for the loop system, any material could be used in its place. In addition, the individual components need not be fabricated from the disclosed materials but could be fabricated from virtually any suitable materials.

Moreover, the individual components need not be formed in the disclosed shapes or assembled in the disclosed configuration, but could be provided in virtually any shape and assembled in virtually any configuration. For instance, calendars of varying shapes and sizes could be used, including miniature calendars that can fit in a user's pocket or larger calendars that allow for further planning beyond a two-month system. Furthermore, all the disclosed features of each disclosed embodiment can be combined with, or substituted for, the disclosed features of every other disclosed embodiment, except where such features are mutually exclusive.

It is intended that the appended claims cover all such additions, modifications, and rearrangements. Expedient embodiments of the present invention are differentiated by the appended claims.

What is claimed is:

1. A calendar comprising:

an erasable loop scheduler comprising:

a board with at least one viewing pane;

a loop system that wraps around the board;

a grid system in conjunction with the loop system, a portion of the grid system displayed in the at least one viewing pane; and means for advancing the grid system around the board; and a separate calendar system connected to the erasable loop scheduler, the separate calendar system comprising:

an upper panel; and a plurality of calendar sheets connected to the upper panel.

2. The calendar of claim 1, wherein the plurality of calendar sheets comprises a front side containing text and graphics and a back side containing a gridded calendar.

3. The calendar of claim 2, wherein the upper panel and the plurality of calendar sheets has a plurality of holes therethrough.

4. The calendar of claim 3, further comprising a coil that is threaded through the plurality of holes to secure the upper panel to the plurality of calendar sheets.

5. The calendar of claim 2, further comprising:

a plurality of holes formed along a bottom of the upper panel;

a plurality of holes formed along a top of the erasable loop scheduler; and a plurality of rings threaded through the plurality of holes formed along the bottom of the upper panel and the plurality of holes formed along the top of the erasable loop scheduler.

6. The calendar of claim 2, further comprising a hole formed in the upper panel and a hole formed in the calendar sheets, wherein the holes align, and wherein the holes are configured to accept a hook.

7. A method of using an erasable loop scheduler connected to a calendar system comprising:

aligning the erasable bop scheduler with the calendar system, wherein the calendar system comprises an upper panel and a plurality of calendar sheet connected to the upper panel;

recording a plurality of reoccurring appointments from a previous calendar to the calendar system;

reviewing the reoccurring appointments from the calendar system;

a lower panel comprising a board with a grid system printed thereon;

writing dates on a transparent overlay that wraps around and covers a first side and a second side of a board, wherein a grid system is formed onto the board;

writing appointments corresponding to the dates on the transparent overlay; and grasping the transparent overlay and sliding it around the board when a horizontal row of dates has passed.

8. The method of claim 7, further comprising the steps of:

flipping the board over; and observing a portion of the grid system with previously-recorded information that has been slid from the first side of the board to a second side of the board.

9. The method of claim 8, further comprising the steps of:

erasing a plurality of expired dates and appointments; and writing a plurality of new dates and appointments on an erased portion of the grid system.

10. An erasable loop scheduler comprising:

a board with at least one viewing pane;

a loop system that wraps around the board, wherein the loops system is made of a an erasable material;

a grid system on with the loop system, a portion of the grid system displayed in the at least one viewing pane;

a calendar system with:

an upper panel; and a plurality of calendar sheets, wherein the plurality of calendar sheets has text related to a specific month on one side of the calendar sheet and a corresponding gridded calendar on an opposite side of the calendar sheet;

means for advancing the grid system around the board; and the calendar system connected to the board.

11. The erasable loop scheduler of claim 10, wherein the grid system includes a plurality of horizontal rows and a plurality of vertical columns.

12. The erasable loop scheduler of claim 10, wherein the grid system has seven cells horizontally by three to ten cells vertically.

13. The erasable loop scheduler of claim 10, wherein the grid system is printed on the loop system, and the loop system is made of a flexible plastic band that accepts an erasable medium.

14. The erasable loop scheduler of claim 10, wherein the board has a first viewing pane on a first side and a second viewing pane located on a second side opposite the first side.

15. The erasable loop scheduler of claim 14, wherein the board displays a first month in the first viewing pane and a second month in the second viewing pane.

16. The erasable loop scheduler of claim 15, wherein the first viewing pane is displays a current month and the second viewing pane displays either a previous month or an upcoming month.

17. The erasable loop scheduler of claim 10, wherein the board has a plurality of mounting holes.

18. The erasable loop scheduler of claim 17, wherein a mounting system has means to mount the erasable loop scheduler to a wall.

* * * * *